US007739893B2

(12) United States Patent
Chien

(10) Patent No.: US 7,739,893 B2
(45) Date of Patent: Jun. 22, 2010

(54) 2-WAY REINFORCEMENT BENDING MACHINE

(76) Inventor: Chun-Jen Chien, No. 300, Hsin Kuang Rd., Yung-Mei Village, Tung-Shan Hsiang, I-Lan Hsien (TW)

( * ) Notice: Subject to any disclaimer, the term of this patent is extended or adjusted under 35 U.S.C. 154(b) by 0 days.

(21) Appl. No.: 10/860,003

(22) Filed: Jun. 4, 2004

(65) Prior Publication Data

US 2005/0268688 A1 Dec. 8, 2005

(51) Int. Cl.
*B21D 7/02* (2006.01)

(52) U.S. Cl. ..... 72/217; 72/218; 72/387

(58) Field of Classification Search ..... 72/217–219, 72/304, 307, 294, 387
See application file for complete search history.

(56) References Cited

U.S. PATENT DOCUMENTS 3,894,422 A * 7/1975 Peddinghaus ..... 72/217
4,052,875 A * 10/1977 Sakamoto ..... 72/217
4,571,974 A * 2/1986 Pollhammer et al. ..... 72/217
5,144,829 A * 9/1992 Fabro et al. ..... 72/294
5,195,348 A * 3/1993 Del Fabro et al. ..... 72/307
5,199,292 A * 4/1993 Del Fabro et al. ..... 72/307
5,537,852 A * 7/1996 Del Fabro et al. ..... 72/387

* cited by examiner

*Primary Examiner*—David Jones
(74) *Attorney, Agent, or Firm*—Jackson IPG PLLC

(57) ABSTRACT

A two-way bending machine for a reinforcement includes a hollow worktable with a top, a drive mechanism, a bending mechanism and a retaining mechanism, the drive mechanism powered by a bi-directional motor to drive the bending mechanism at a reduced rotation, the bending mechanism being extended to the top where a turntable is provided, multiple positioning holes at the center of and on the turntable for insertion of a positioning member and a retaining member to hold the reinforcement in position, the retaining mechanism including two retaining blocks, a track and an air cylinder with both retaining blocks alternatively traveling laterally to get close to the left or the right side of the turntable to serve a support in the bending.

6 Claims, 9 Drawing Sheets

2-WAY REINFORCEMENT BENDING MACHINE

BACKGROUND OF THE INVENTION (a) Field of the Invention

The present invention is related to a 2-way reinforcement bending machine, and more particularly, to one that bends reinforcement or steel pipe or the equivalent in a fast and easy fashion that is substantially free of defects.

(b) Description of the Prior Art

A constructional structure is usually made of cement and reinforcements. Wherein, the reinforcement must be bent into a certain shape as required so to provide the style sought by the structure, such as a beam, pillar or wall before pouring the cement. The bending machine for this purpose that is generally available in the market is essentially comprised of a turntable, a positioning member at the center of the turntable and a plunger on the peripheral of the turntable; a drive motor is used to control the turntable to rotate in one direction only; and a reinforcement is placed between the positioning member and the plunger with the turntable as a support to be pushed against the plunger and bent into a certain shape as desired. However, the prior art allows the bending only in one direction. When a certain shape such as a "⊓" shape is desired for the reinforcement, one end of the reinforcement must be first bent and the reinforcement must be removed to change for bending the other end. The bending job becomes awkward, particularly so when the reinforcement is 5 meter in length or longer and/or heavier that demands at the same time a larger working space because the reinforcement has to be shifted in another direction. Consequently, the prior art is consuming too much time, effort and, as a result, offers reduced production speed. Furthermore, the prior art operates solely upon the turntable, the positioning member and the plunger without retaining or locking the reinforcement in position. Therefore, the reinforcement is vulnerable to produce an arc deformation, and larger curvature to thereby increasing waste materials, thus increasing cost that otherwise can be saved.

SUMMARY OF THE INVENTION

The primary purpose of the present invention is to provide a two way bending machine for a reinforcement that is adapted with a retaining mechanism to allow fast and easy bending of the reinforcement or a steel pipe to produce an end product free of undesired deformation. To achieve the purpose, the present invention includes a worktable, a drive mechanism, a bending mechanism and a retaining mechanism. Wherein, the worktable relates to a hollow structure to permit the bending process on the table; the drive mechanism is comprised of a bi-directional motor, an intermediate shaft and a chain gear set for the reduction of the power source to rotate the bending mechanism; the bending mechanism is erected inside the worktable and extends to the table to be coupled with a turntable; multiple positioning holes are provided at the center of the turntable and selected locations on the peripheral of the turntable to allow insertion of positioning members and retaining members to push and compress the reinforcement in the bending process; and on one side of the turntable the retaining mechanism is comprised of two retaining blocks, one track and an air cylinder is provided so that those two retaining blocks alternatively travel laterally to get close to the left side and the right side to the turntable to sever as the support for bending the reinforcement in both directions.

DETAILED DESCRIPTION OF THE PREFERRED EMBODIMENTS

Figure 1:
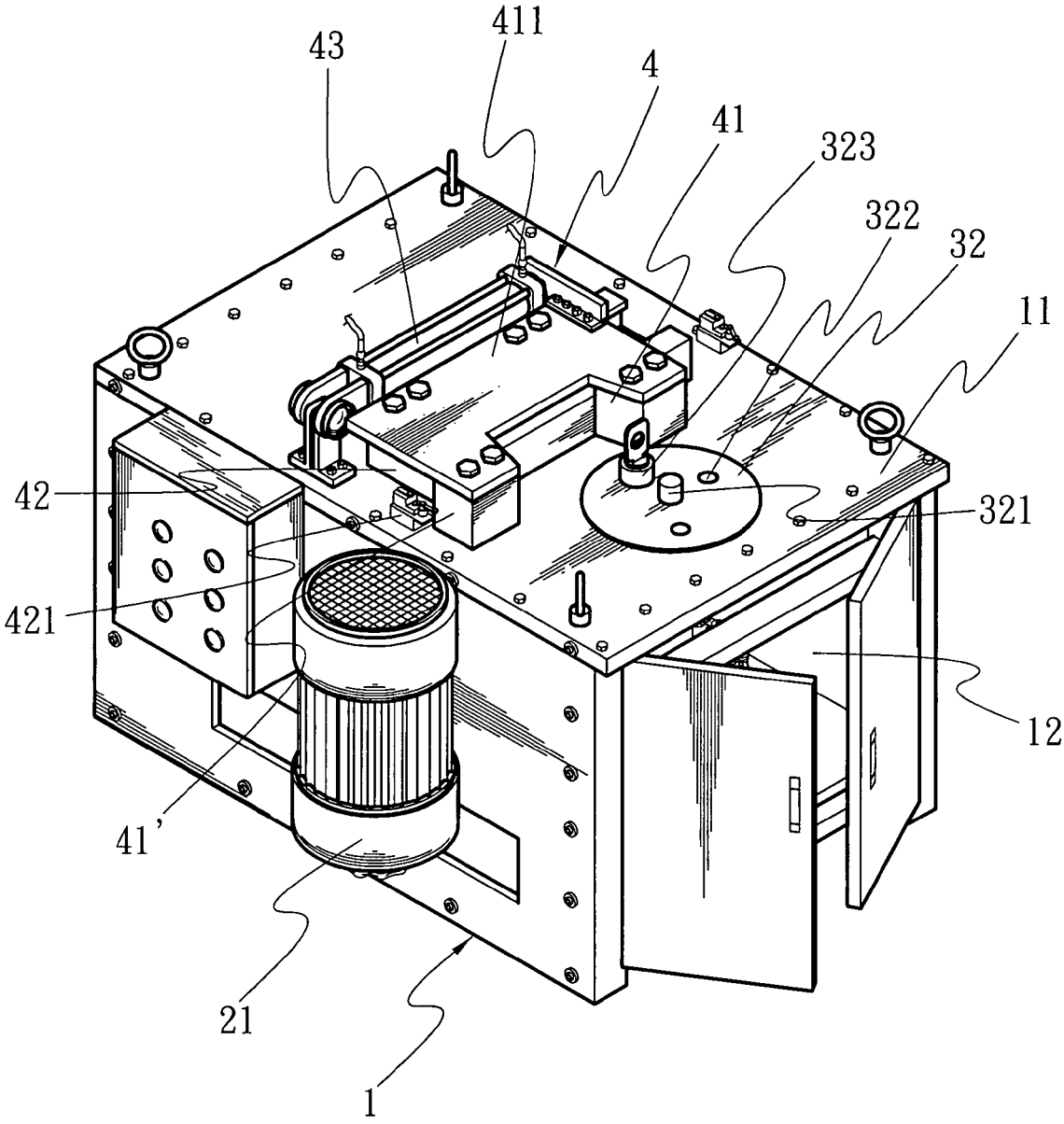
FIG. 1 is a perspective view of a preferred embodiment of the present invention as assembled.

Referring to FIGS. 1 through 4, a preferred embodiment of the present invention of a two-way bending machine for a reinforcement, a steel strip, or a steel pipe or the equivalent is essentially comprised of a worktable 1, a drive mechanism 2, a bending mechanism 3 and a retaining mechanism 4.

Figure 2:
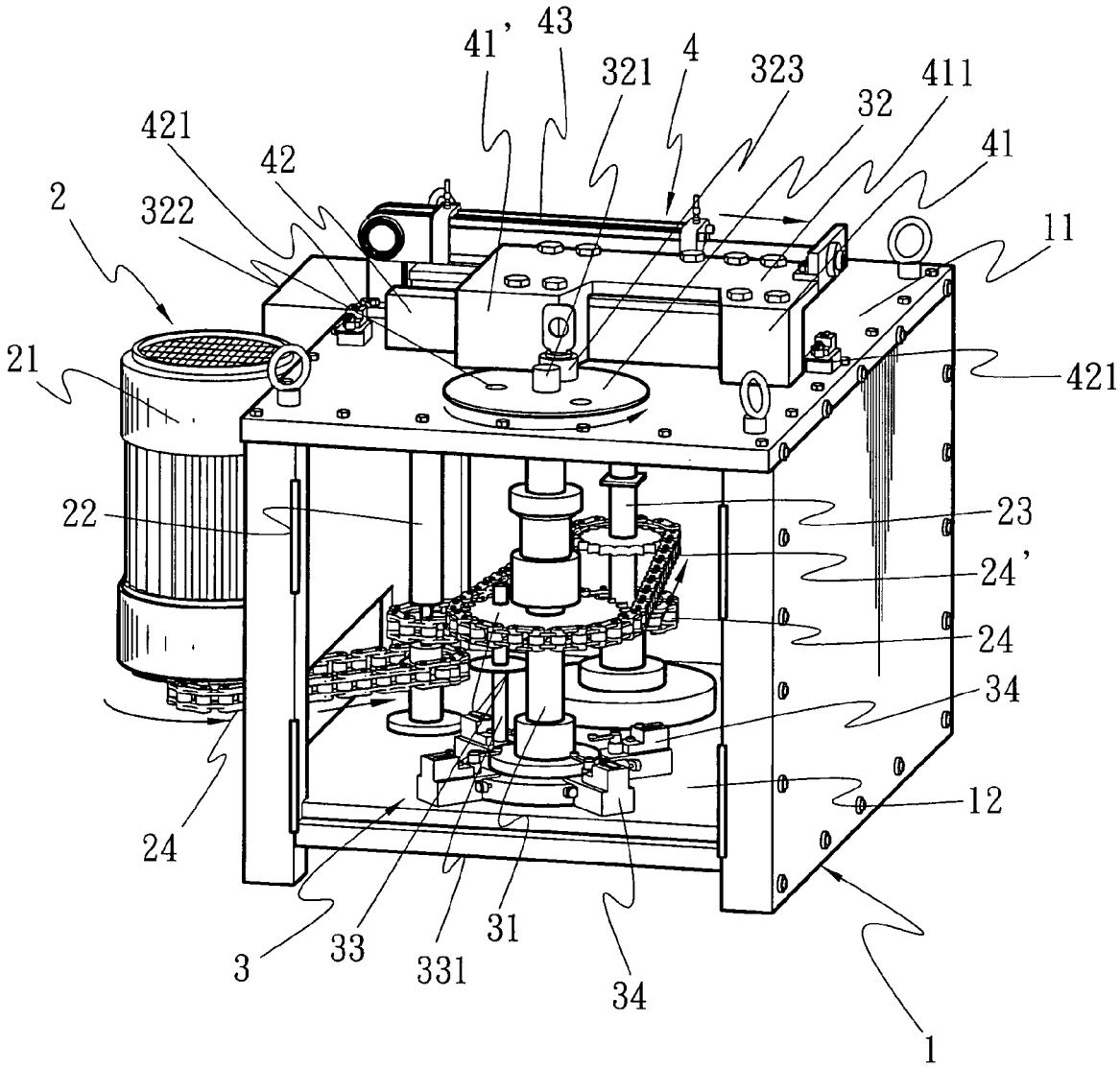
FIG. 2 is a perspective view of the interior of the preferred embodiment of the present invention.

The worktable 1, as illustrated in FIGS. 1 and 2, relates to a hollow structure provided with a top 11 for carrying on the bending process, a space 12 below the table is defined to accommodate another mechanism, and the appearance of the worktable may be in a rectangular, circular or other structural form.

Figure 3:
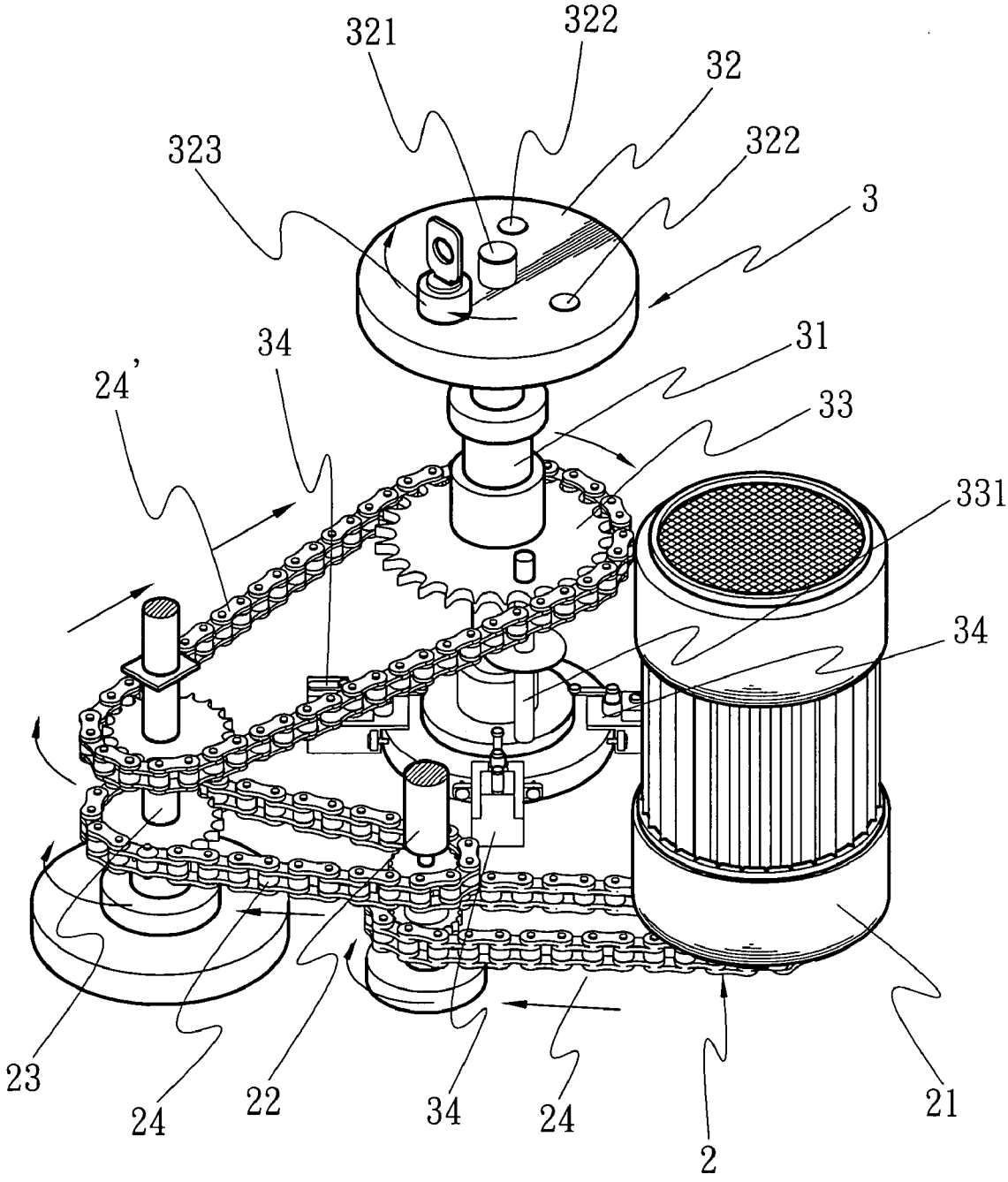
FIG. 3 is a perspective view of a drive mechanism and a bending mechanism of the preferred embodiment of the present invention.

The drive mechanism 2 as illustrated in FIGS. 2 and 3 includes a bi-directional motor 21, two intermediate shafts 22, 23 and two chain gear sets 24, 24'. The bi-directional motor 21 is provided at a selected location on the worktable 1 (or external to the worktable 1 as illustrated). Those two intermediate shafts 22, 23 are respectively provided in the space 12 of the worktable 1 whereby two reduction chain gear sets 24 (comprised of a chain and a sprocket of the prior art) are respectively provided between the bi-directional motor 21 and the intermediate shaft 22 and where between those two intermediate shafts 22, 23 for the intermediate shaft 23 to perform reduced rotation. The chain gear set 24' is coupled to the bending mechanism 3 to become the drive mechanism 2 to reduce the power source for the rotation of the bending mechanism 3.

Figure 4:
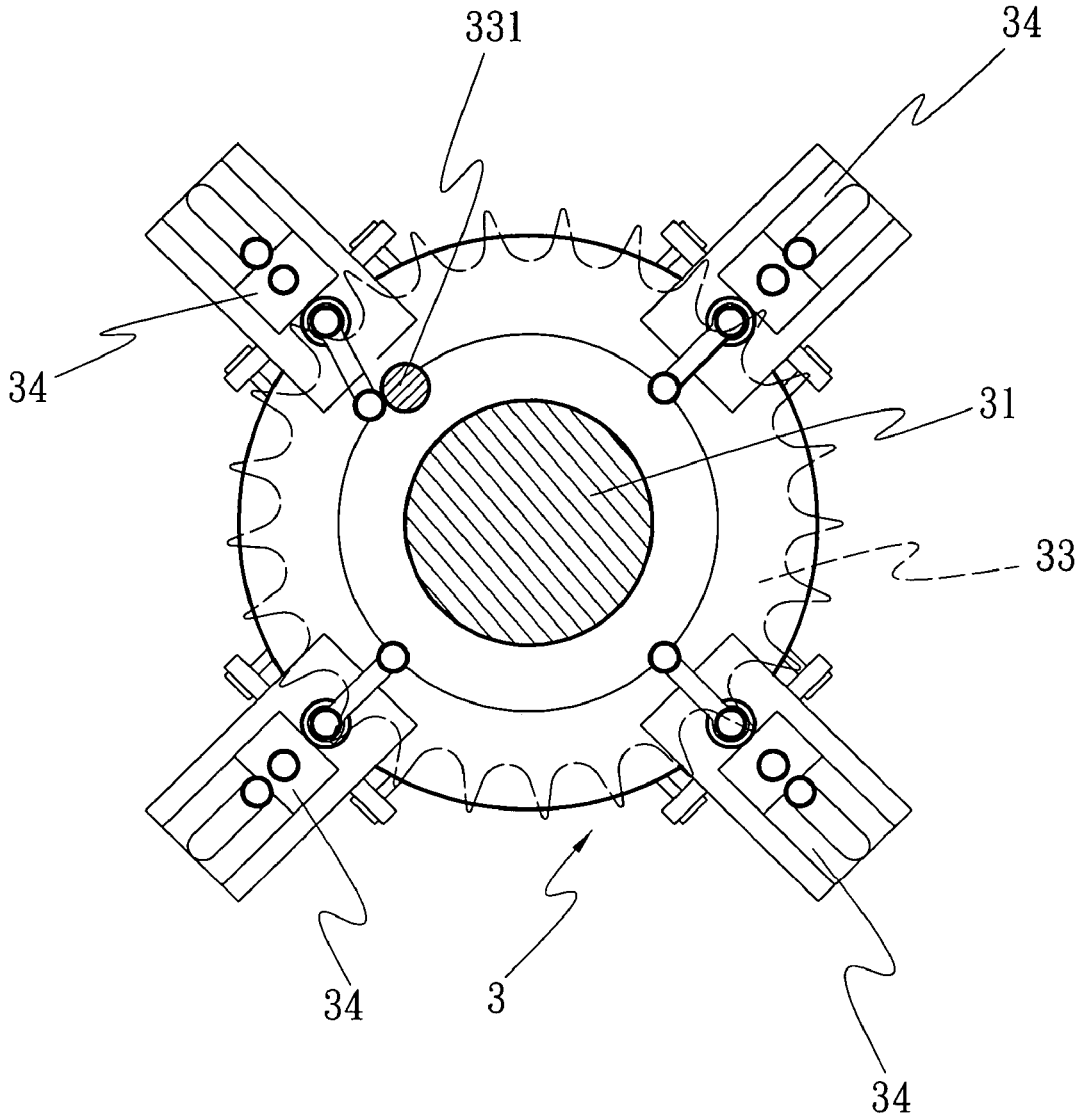
FIG. 4 is a sectional view of the bending mechanism of the preferred embodiment of the present invention.

As illustrated in FIGS. 2, 3, and 4, the bending mechanism 3 includes a main shaft 31, a turntable 32, a sprocket 33 and a touch switch 34. Wherein, the main shaft 31 is erected inside the space 12 of the worktable 1 and extended to the top 11 to be coupled to the turntable 32, a positioning member 321 is provided at the center of the turntable 32 and multiple positioning holes 322 provided on the peripheral of the turntable 32 for the insertion of a pillar retaining member 323. The sprocket 33 provided to the body of the main shaft 31 is adapted in conjunction with the chain from the chain gear set 24'. A touch rod 331 is provided either on the upper or the lower surface of the sprocket 33 that rotates synchronously with the sprocket 33. Multiple touch switches 34 are provided on the rotation route of the touch rod 331 whereby the bending mechanism 3 is provided to bend the reinforcement by means of the turntable 32 while the drive mechanism 2 controlled by the touch rod 331 and the touch switches 34 to stop the bending in time.

The retaining mechanism 4 as illustrated in FIGS. 1 and 2 includes two retaining blocks 41, 41', a track 42 and an air cylinder 43 mounted on the top 11 of the worktable 1. A connection base 411 is either integrated or assembled to the two retaining blocks 41, 41' to separate them apart. The track 42 (in the form of dovetail rail and channel, T-rail and channel or roller linear track of the prior art) is provided below the connection base 411 with the track 42 fixed to the top 11 of the worktable 1 and two touch switches 421 are respectively provided on both ends of the track 42 to control the traveling of the connection base 411 and those two retaining blocks 41, 41'. The air cylinder 43 (or an oil hydraulic cylinder linear motion device such as a guide worm gear set or a roller guide worm gear set) is provided on the connection base 411 to connect to a power source for the connection base 411 and the two retaining blocks 41, 41' provided that the two retaining blocks 41, 41' are located on one side of the turntable 32 for them to alternatively travel laterally to get close to the left side or the right side to the turntable 32 for serving as the support in bending the reinforcement in either direction.

By means of the structural characteristics respectively of the worktable 1, the drive mechanism 2, the bending mechanism 3 and the retaining mechanism 4, the two-way bending machine for the reinforcement of the present invention is assembled for the application in bending the reinforcement, steel strip or steel pipe.

Figure 5:
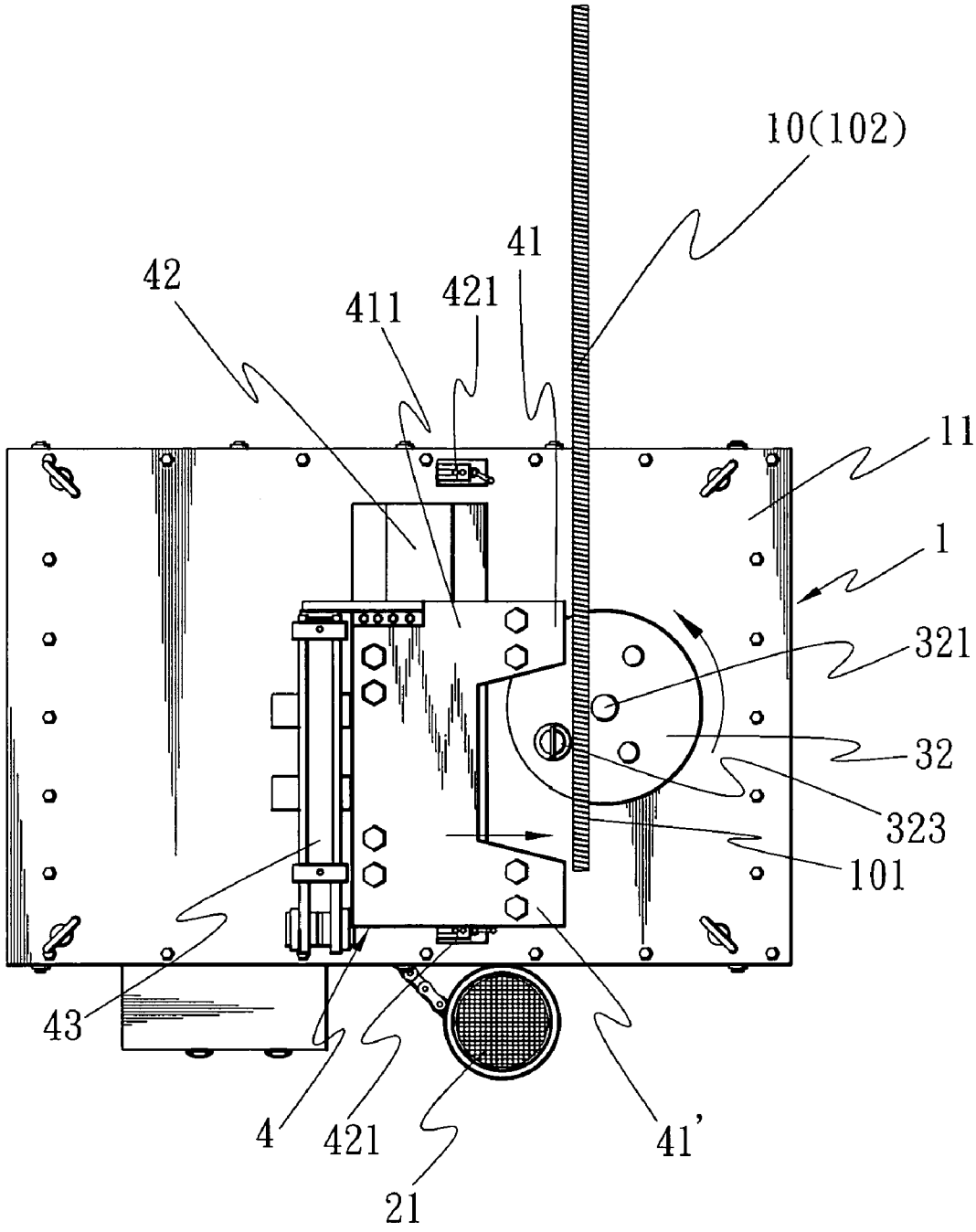
FIG. 5 is a schematic view showing one end of a reinforcement is placed in the preferred embodiment of the present invention before the bending process.
Figure 6:
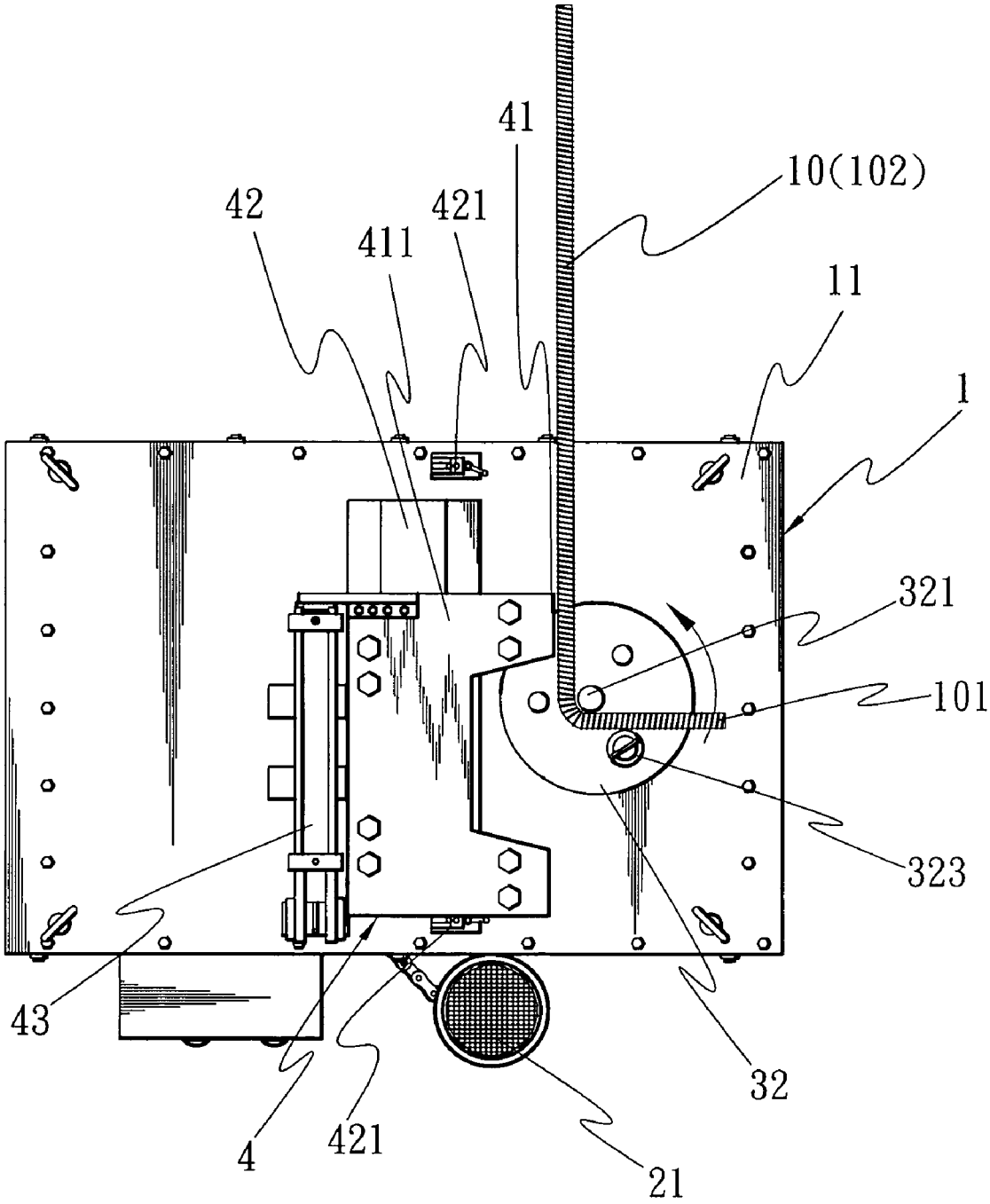
FIG. 6 is a schematic view showing that one end of the reinforcement after being bent.
Figure 7:
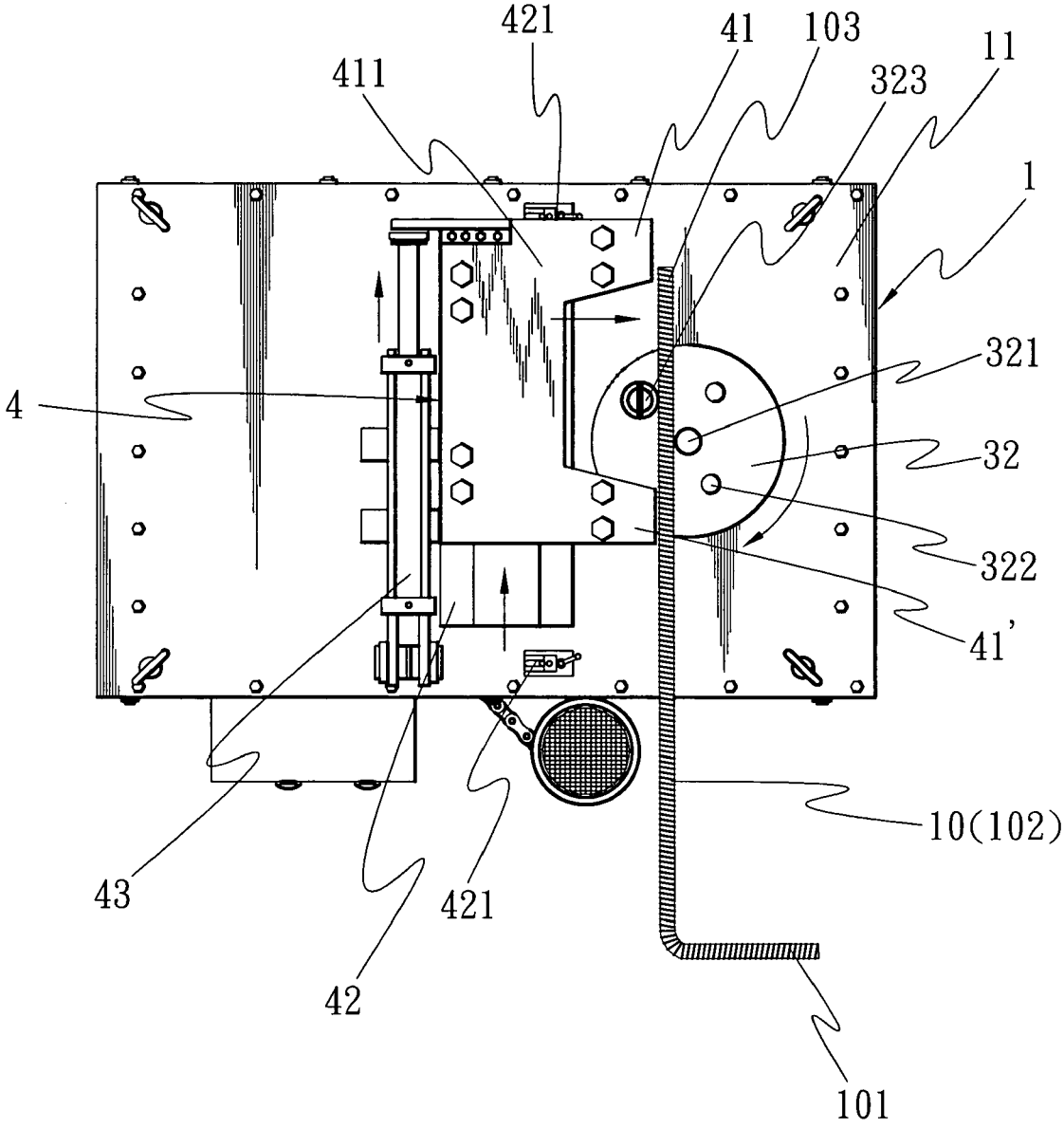
FIG. 7 is a schematic view showing the other end of the reinforcement being placed in the preferred embodiment of the present invention before another bending process.
Figure 8:
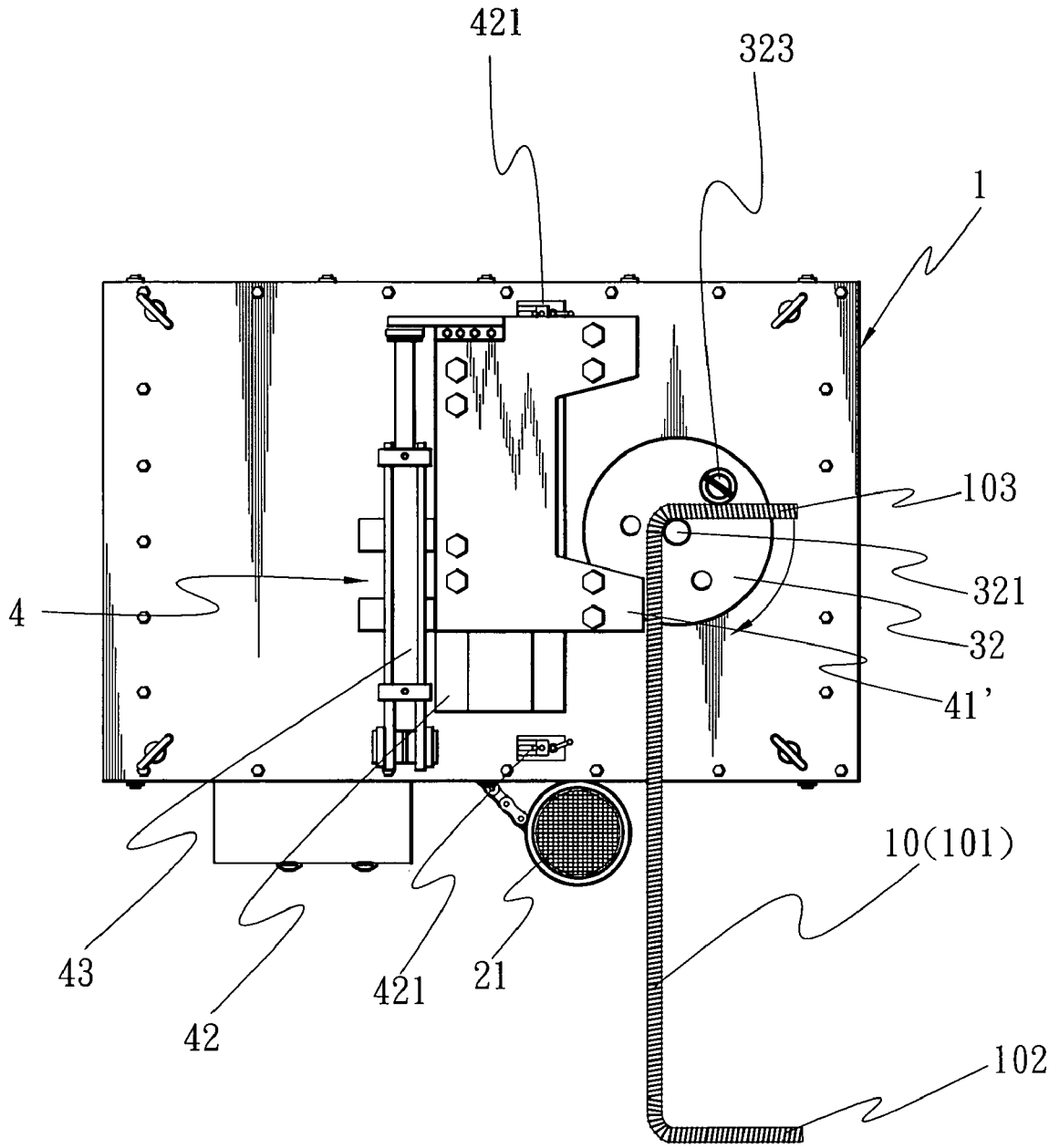
FIG. 8 is a schematic view showing the other end of the reinforcement after being bent.

Now referring to FIG. 5, a section 101 of a reinforcement 10 to be bent is put between the positioning member 321 and the retaining member 323 of the turntable 32. The retaining block 41 of the retaining mechanism 4 travels to the back of a fixed section 102 of the reinforcement 10 to start the drive mechanism 2 to rotate the turntable 32. The positioning member 321 is used as the bending support while the retaining member 323 pushes and compresses the section 101 of the reinforcement 10 to be bent as illustrated in FIG. 6. As illustrated in FIG. 7, if the other end of the reinforcement 10 needs to be bent, the reinforcement 10 is directly pulled to allow the other end of the section 103 to pass between the positioning member 321 and the retaining member 323 of the turntable 32. The retaining block 41 of the retaining mechanism 4 travels to the back of another fixed section 102 of the reinforcement 10 to activate the drive mechanism 2 to rotate the turntable 32 in the opposite direction with the positioning member 321 as the bending support for the retaining member 323 to push and compress a section 103 of the reinforcement 10 to be bent as illustrated in FIG. 8. Accordingly, the present invention allows fast bending of both ends of the reinforcement to save the trouble of handling the reinforcement 10 by turning it for 180° thus to achieve fast and easy bending process. While in the bending process, the retaining mechanism 4 serves as the support to prevent any undesired deformation of the reinforcement 10 thus resulting in a more precise shape and increased acceptance of the processed reinforcement 10.

Figure 11:
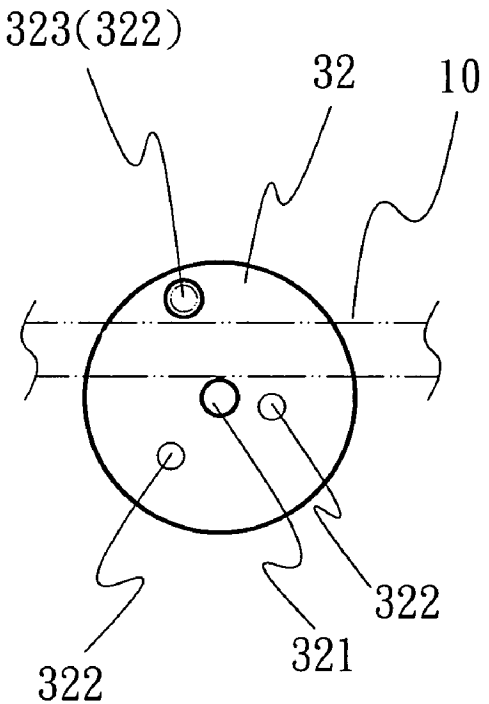
FIG. 11 is a schematic view showing another reinforcement having a larger diameter being bent in the preferred embodiment of the present invention.
Figure 10:
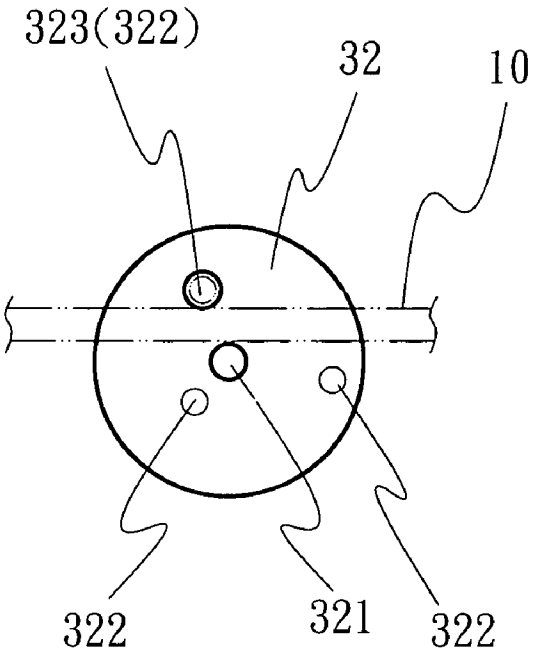
FIG. 10 is a schematic view showing another reinforcement having a medium diameter being bent in the preferred embodiment of the present invention.
Figure 9:
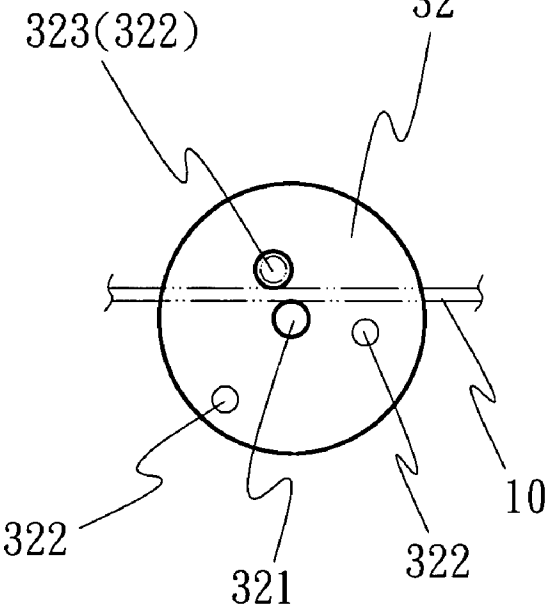
FIG. 9 is a schematic view showing a reinforcement having a smaller diameter being bent in the preferred embodiment of the present invention.

Furthermore, as illustrated in FIGS. 9, 10, and 11, multiple positioning holes 322 are provided to the turntable 32 with each at different distances from the positioning member 321 for the insertion of the pillar retaining member 323 in coping with the reinforcement 10 in various diameters to expand the application range of the present invention.

What is claimed is:

1. A two-way bending machine for bending a metal reinforcement is comprised of a worktable, a drive mechanism, a motor, a bending mechanism and a retaining mechanism; wherein, the worktable is provided with a top and an accommodation space below the top; the drive mechanism powered by a motor to drive the bending mechanism; the bending mechanism including a turntable and a pillar retaining member and at least one main shaft being erected in the accommodation space in the worktable and extending to the top of the worktable to be coupled with the turntable, a positioning member being disposed at a center of the turntable, multiple positioning holes being provided on a peripheral area of the turntable for the insertion of the pillar retaining member as desired, the body of the main shaft being provided with a sprocket rotationally linked to the drive mechanism, and the main shaft being rotated as driven by the drive mechanism; and the retaining mechanism including two retaining blocks, a track and an air cylinder provided on the top of the worktable, the two retaining blocks being located on one side to the turntable, a connection base being provided to separate both retaining blocks; the track and the air cylinder being provided to the connection base and fixed to the top of the worktable to control the travel by the connection base and the two retaining blocks, and the two retaining blocks traveling laterally towards a left or a right side of the turntable to serve as the support for the metal reinforcement.

2. A two-way bending machine for bending a metal reinforcement as claimed in claim 1, wherein, the drive mechanism includes a bi-directional motor, two intermediate shafts and a chain gear set; the bi-directional motor being connected to the worktable, both intermediate shafts being respective erected in the accommodation space in the worktable, a reduction chain gear set being each provided between the bi-directional motor and one of the intermediate shafts and also between both intermediate shafts to achieve reduced rotation, and another chain gear set being provided to be coupled to the bending mechanism to reduce the rotation speed of the bending mechanism.

3. A two-way bending machine for bending a metal reinforcement as claimed in claim 1, wherein, the sprocket of the bending mechanism includes a touch rod provided on the turntable, the touch rod rotating synchronously with the sprocket, and multiple touch switches are provided on the rotation route of the touch rod to control the drive mechanism.

4. A two-way bending machine for bending a metal reinforcement as claimed in claim 1, wherein, one touch switch is each provided at both ends of the track.

5. A two-way bending machine for bending a metal reinforcement as claimed in claim 1, wherein, the track is provided in the form of a dovetail rail and channel, a T-shape rail and a channel, or a roller linear track.

6. A two-way bending machine for bending a metal reinforcement as claimed in claim 1, wherein, a hydraulic cylinder, a guide worm gear set and a roller guide gear worm set are provided on the connection base.

* * * * *